US007400854B2

(12) United States Patent
Fukuda

(10) Patent No.: US 7,400,854 B2
(45) Date of Patent: Jul. 15, 2008

(54) FIXING DEVICE AND FIXING METHOD

(75) Inventor: Yoshiyuki Fukuda, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 316 days.

(21) Appl. No.: 11/230,542

(22) Filed: Sep. 21, 2005

(65) Prior Publication Data

US 2006/0083560 A1 Apr. 20, 2006

(30) Foreign Application Priority Data

Oct. 19, 2004 (JP) ..... 2004-304551

(51) Int. Cl.
*G03G 15/20* (2006.01)

(52) U.S. Cl. ..... 399/327

(58) Field of Classification Search ..... 399/98, 399/99, 122, 320, 326, 327; 15/256.5, 256.51, 15/256.52, 88.3
See application file for complete search history.

(56) References Cited

U.S. PATENT DOCUMENTS 4,407,219 A * 10/1983 Dellevoet ..... 118/60
6,223,016 B1 * 4/2001 Jia et al. ..... 399/327
7,074,540 B2 * 7/2006 Nukada et al. ..... 430/119.71
7,079,799 B2 * 7/2006 Mills et al. ..... 399/327
7,248,826 B2 * 7/2007 Jones et al. ..... 399/327
2005/0180786 A1 * 8/2005 Yamada et al. ..... 399/327
2006/0024097 A1 * 2/2006 Yamada et al. ..... 399/327

FOREIGN PATENT DOCUMENTS

JP 2000-250349 A 9/2000
JP 2001-312173 A 11/2001

* cited by examiner

*Primary Examiner*—David M. Gray
*Assistant Examiner*—Andrew V Do
(74) *Attorney, Agent, or Firm*—Foley & Lardner LLP

(57) ABSTRACT

Cleaning brush is provided in the down stream of the cleaning member around the pressing member, and after toner stuck to the pressing member is recovered by the cleaning member, calcium carbonate stuck to the pressing member is recovered by the cleaning brush. Thus the toner volume stuck to the surface of cleaning brush is reduced and the calcium carbonate recovery performance by the cleaning brush is maintained.

12 Claims, 4 Drawing Sheets

FIXING DEVICE AND FIXING METHOD

CROSS-REFERENCE TO RELATED APPLICATION

This application is based upon and claims the benefit of priority from the prior Japanese Application No. 2004-304551, filed Oct. 19, 2004, the entire contents of all of which are incorporated herein by reference.

FIELD OF THE INVENTION

The present invention relates to a fixing device and fixing method that is used in image forming apparatus such as copiers, printers, or a facsimiles, etc. to fix a developer image formed on a recording medium.

DESCRIPTION OF THE BACKGROUND

In case of fixing device for electro-photographic image forming apparatus such as copiers, printers etc., toner image is fixed on paper by passing paper through a nip between a pair of rollers consisting of a heat roller and a press roller, or similar belts. In such a fixing device, a phenomenon that a portion of the toner image sticks to the heat roller at the time of fixing, may take place, and the toner stuck to the heat roller is further transferred to the press roller, so that the press roller is suffered from corruption. For this reason, a device is provided in which a metallic cleaning roller is pushed on the press roller to remove the toner stuck to the press roller and the toner is deposited on the surface of the cleaning roller.

On the other hand, in such a fixing device, a phenomenon that particle of calcium carbonate which is a composition of paper sticks to the press roller at the time of fixing takes place. As the particle is apt to stick to the toner, especially when the European paper or Chinese paper etc. which contains a large quantity of calcium carbonate is used, a phenomenon that particle of calcium carbonate in the paper is mixed with the toner stuck to the surface of the press roller and the mixture sticks to the press roller takes place.

As the stuck toner mixed with the particle calcium carbonate forms balls and the stickiness is weak, the toner sticks again to the press roller after cleaning by the cleaning roller and, as the result, paper may suffer from corruption. Or the cleaning performance of the cleaning roller may be reduced. Furthermore, in case of Chinese paper, rough calcium carbonate of irregular shape is contained often. For example, there has been a case that the number of detected rough particles of calcium carbonate that are more than 20 μm in length was 1,204 pieces/$cm^2$.

The stuck toner that is mixed with such rough particles of calcium carbonate of irregular shape can be recovered hardly by a cleaning roller and deposited on the surface of the press roller and, as the result, the press roller and paper are suffered from corruption. Or the cleaning performance of the cleaning roller may be reduced. Also, when the heat roller and the press roller are pressed each other, as the rough particles of irregular shape, consisting of calcium carbonate and the stuck toner exist on the surface of press roller, the surface of the heat roller may cause dents. As the result, the smooth surface of the heat roller is roughed. The roughed surface of the heat roller reduces the shape-separating performance of the heat roller. As the result, the toner stuck to the heat roller from the toner image at the time of fixing increased, and the quality of the image was deteriorated due to the drop of the fixing performance and/or corruption of paper.

For this reason, as shown in Japanese Patent Application Publication No. 2001-312173, there is an apparatus that the toner stuck to the press roller is removed completely by utilizing both a cleaning roller that removes the toner stuck to the surface of the press roller and a cleaning brush that removes the adhesion from the press roller such as particles of calcium carbonate.

However, in case of the cleaning brush laid open by Japanese Patent Application Publication No.2001-312173, the cleaning brush is located in the upper stream of the cleaning roller in the turning direction of the press roller. Such being the case, when the particles of calcium carbonate on the press roller are removed, the toner stuck to the press roller is caught by the cleaning brush that contacts at first. For this reason, when the paper which contains a large quantity of calcium carbonate is used, cleaning brush is pushed to the press roller and mainly particles of calcium carbonate are removed by the cleaning brush. On the other hand, when paper containing a small volume of calcium carbonate is used, the cleaning brush is separated from the press roller, in order to prevent that the toner with strong adhesion stuck to the cleaning brush is transferred to the press roller. As in this case, a construction that the contact position of the cleaning brush can be changed against the press roller is provided. Such being the case, there is a problem that the mechanism supporting the cleaning brush becomes complicated in the case of the fixing device laid open by Japanese Patent Application No. 2001-312173.

SUMMERRY OF THE INVENTION

The present invention is to solve the problems described in the above. The object of the present invention is to provide a fixing device and a fixing method which does not require to provide a position changing mechanism of the auxiliary cleaning member for removing the adhesion such as calcium carbonate from the pressing member, which can reduce the re-adhesion of toner from the cleaning auxiliary member to the pressing member and the calcium carbonate recovery efficiency on the pressing member by means of cleaning auxiliary member is maintained.

According to the embodiment of the present invention, there is provided a fixing device comprising; a fixing member; a pressing member to convey a medium with toner image to be fixed in a prescribed direction by pressing the fixing member; a cleaning member to recover toner stuck to the surface of the pressing member by contacting the pressing member; and a cleaning auxiliary member to recover the adhesion on the surface of the pressing member in the down stream of the cleaning member in the turning direction of the pressing member.

Furthermore, according to the embodiment of the present invention, there is provided a fixing device comprising; fixing means for fixing a toner image on a medium; pressing means for conveying the medium with the toner image to be fixed in a prescribed direction by pressing the fixing means; cleaning means for recovering the toner stuck to the surface of the pressing means by contacting the pressing means; and cleaning auxiliary means for recovering the adhesion on the surface of the pressing means in the down stream of the cleaning means in the turning direction of the pressing means.

Also, according to the embodiment of the present invention, there is provided a fixing method comprising; conveying medium with toner image to be fixed in a prescribed direction by pressing a pressing member to a fixing member; recovering the toner stuck to the surface of the pressing member by having a cleaning member contacted the pressing member; and recovering the adhesion on the surface of the pressing member by a cleaning auxiliary member arranged in the down stream of the cleaning member in the turning direction of the pressing member.

DETAILED DESCRIPTION OF THE EMBODIMENTS

Figure 1:
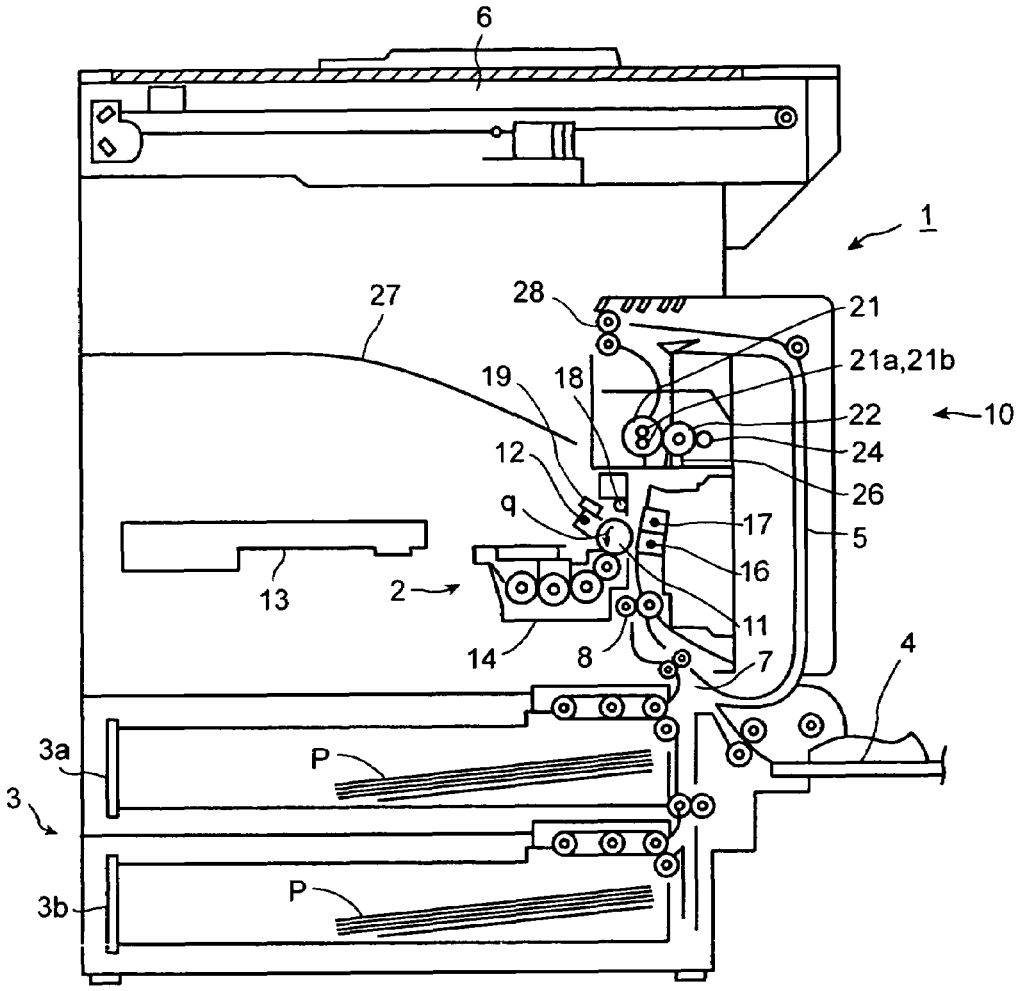
FIG. 1 is a front view sketch showing a copier comprising a fixing device according to the first embodiment of the present invention.

Hereinafter the first embodiment of the present invention is described using the FIGS. 1 to 7. FIG. 1 is a front view sketch showing copier 1 provided with the fixing device 10 according to the present invention. Copier 1 is provided with a cassette structure 3 having a paper supply cassette 3*a* and 3*b* that supplies paper which is a medium to be fixed, to the image forming unit 2, a manual paper supply structure 4, and furthermore a paper reversing conveyer route 5 that reverse paper P when the images are formed on both sides of paper.

In case of cassette structure 3 or manually paper supply structure 4, various kinds of papers such as normal paper which contains a small quantity of calcium carbonate, European paper which contains a large quantity of calcium carbonate, or Chinese paper which contains a large quantity of rough calcium carbonate of irregular shape, can be supplied. An aligning roller 8 is provided above the conveyer route 7 from cassette structure 3, manual paper supply structure 4 and paper reversing conveyer route 5 to image forming unit 2.

A scanner unit 6 which reads out manuscript image is provided on the top of copier 1. Image forming unit 2 is provided with a main charger 12 which charges a photosensitive drum 11 successively according to the turning direction of the photosensitive drum 11 indicated by the arrow q, an exposure (not shown in the drawing) of laser exposure unit 13 which forms a latent image on the photosensitive drum 11 basing upon the image data from scanner unit 6, developing device 14, a transfer charger 16, a separation charger 17, a cleaner 18 which recovers toner, and a charge eliminating LED 19 around photosensitive drum 11.

Figure 2:
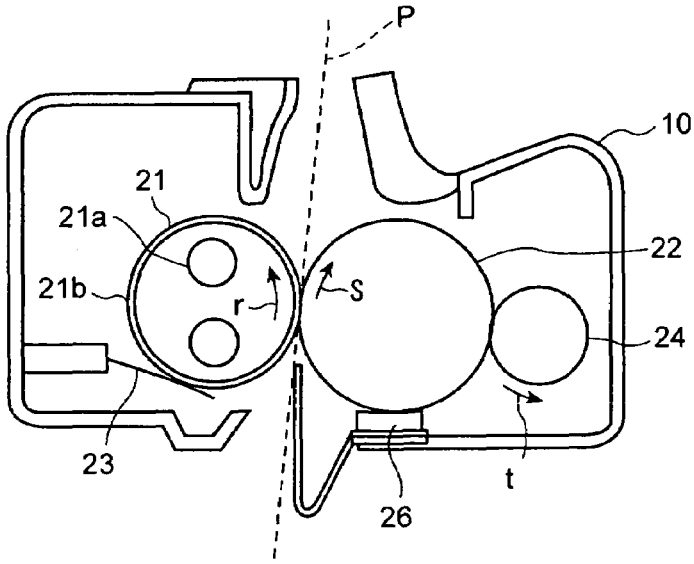
FIG. 2 is a section drawing showing a fixing device according to the first embodiment of the present invention.

Above image forming unit 2, a fixing device 10 comprising a heat roller 21 which is a fixing member and a press roller 22 which presses against heat roller 21 as a pressing member or the pressing means is provided. As shown in FIG. 2, heat roller 21 is made by coating the surface of a hollow aluminum roller with PTFE (Polytetrafluoroethylene) film. Heat roller 21 involves a center heater lamp 21*a* and side heater lamp 21*b*. Center heat lamp 21*a* and side heat lamp 21*b* keeps the surface of heat roller 21 at about 150 to 160° C. by on/off controlling by monitoring the temperature of a thermostat 23.

Press roller 22 is a silicon rubber roller which surface is coated with perfluoroalkylvinylether tube and is formed at hardness Ascar C 50°. At the time of fixing press roller 22 is loaded with a total weight of 150 N against heat roller 21 by means of springs (not shown in the drawing) located at the both ends. Press roller 22 follows the heat roller 21 which is driven by a motor provided on the rear side (not shown in the drawing) turning in the direction of arrow r at the circumference speed of 130 mm/sec, and turn in the direction of arrow S.

Cleaning roller 24 made of an aluminum roller contacts press roller 22 by means of springs (not shown in the drawing) at the both ends. As cleaning roller 24 is driven by press roller 22 and the toner on the surface of press roller 22 is deposited and softened, cleaning roller 24 recovers the toner stuck to press roller 22. Cleaning brush 26 contacts the lowest end of press roller 22, before reaching to the contact point with heat roller 21 in the down stream of cleaning roller 24 in the turning direction of press roller 22. Cleaning brush 26 is a cleaning auxiliary member and contacts press roller 22 to recover the adhesion on press roller 22.

Figure 3:
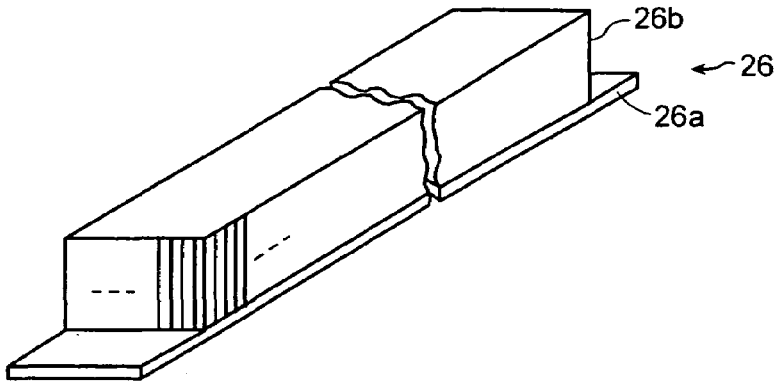
FIG. 3 is a perspective drawing of a cleaning brush according to the first embodiment of the present invention.

As shown on FIG. 3, cleaning brush 26 is a rayon brush 26*b* fixed to a bracket plate 26*a* by means of both sides adhesive tape (not shown in the drawing). As rayon brush 26*b*, a brush with a brush density of 50,000/cm$^2$ which is 10 mm in brush width, 310 mm in length and 6 mm in height, is used. The biting depth of rayon brush 26*b* against press roller 22 is set as 1.3 mm. The material of cleaning brush is not limited to rayon but any acryl brush, electrically conductive fiber (for example, Kuracarbo (made by Kuraray Co.), SA-7 (made by Toray Co.) or Beltron (made by Kanebo Synthetic fiber Co.) may be also used.

In the down stream of paper P transferring direction from fixing device 10, there is provided a paper ejection roller 28 which ejects paper P to a paper ejecting unit 27 after fixing.

In the following the function is described. Manuscript is read out by a scanner unit 6 by starting the image forming process. As photosensitive drum 11 turns in the direction of arrow q, image forming unit 2 is charged homogeneously by main charger 12 and a static electric latent image is formed on image forming unit 2 as laser beams is irradiated by a laser exposure 13 according to the manuscript image. Next, the static electric latent image is developed by a developing device 14 and a toner image is formed on photosensitive drum 11. On the other hand, specified paper p which is supplied from cassette structure 3 or manual paper supply structure 4 is conveyed to the position of transfer charger 16 in synchronization with the toner image on photosensitive drum 11 by means of aligning roller 8, and the toner image on photosensitive drum 11 is transferred onto paper P.

Next, paper P is separated from photosensitive drum 11 and thereafter is passed through the nip between heat roller 21 and press roller 22 of fixing device 10, and the toner image is heated, pressed and fixed to paper P which is ejected to the paper ejection unit 27. After the transfer of toner image, the remaining toner is removed by cleaner 18 from photosensitive drum 11 and the remaining electric charge is removed by charge eliminating LED 19 and stands by for the next image forming process.

As described in the above, as long as image forming process is repeated, toner stuck to heat roller from paper P by transferring sticks to press roller 22. The toner stuck to press roller 22 is recovered by cleaning roller 24 turning in the direction of arrow t by contacting press roller 22 turning in direction of arrow s. However, when a large quantity of calcium carbonate is contained as in the cases of European paper and Chinese paper, particles of calcium carbonate remains on press roller 22 which passed from cleaning roller 24. These particles of calcium carbonate on press roller 22*b* are recovered and removed by rayon brush 26*b* during passing from cleaning brush 26 and then press roller 22 is prepared to operate for next fixing process. Meantime, when cleaning brush 26 becomes full with calcium carbonate, cleaning brush 26 is exchanged by a service man.

As the result, in spite of usage of paper P containing a large quantity of calcium carbonate as in the case of European Paper or Chinese paper, press roller 22 is never corrupted by the sticking toner. Also, the surface of heat roller 21 was not roughed by particles of calcium carbonate remaining on press roller 22 and paper was not corrupted, and a good fixed image was obtained.

Figure 4:
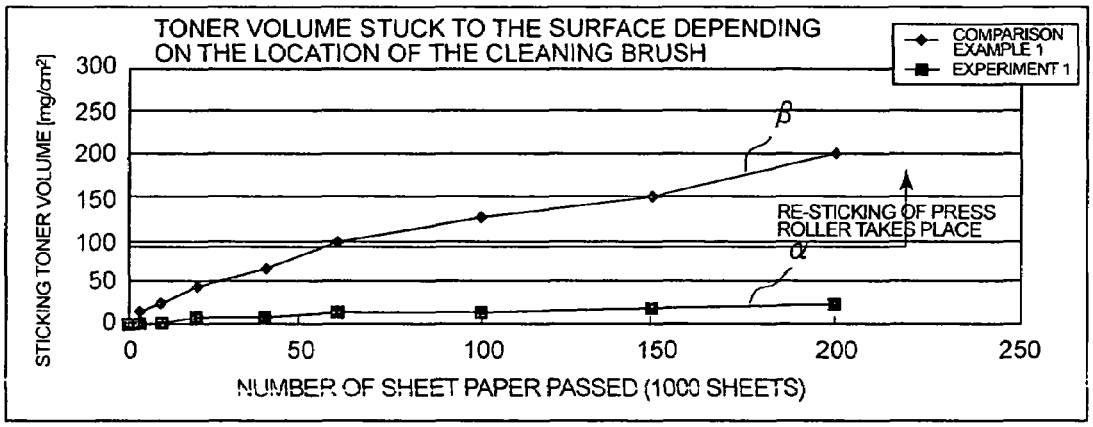
FIG. 4 is a graph showing the volume of toner stuck to the surface of the cleaning brush in case of Experiment 1 and in case of Comparison example 1 at the Experiment 1, according to the first embodiment of the present invention.

(Experiment 1) When, in the present embodiment, the position of cleaning roller 24 and the one for cleaning brush 26 are exchanged, and the volumes of toner stuck to the surface of cleaning brush 26 are compared, the result shown in FIG. 4 was obtained. As in the case of this embodiment, when cleaning roller 24 is arranged in the upper stream in the turning direction and cleaning brush 26 is arranged in the down stream of the turning direction around press roller 22 (Experiment 1), the volume of toner stuck to the surface of cleaning brush 26 is less than 25 mg/cm$^2$, even when 200,000 sheets of paper were passed, as the sold line a shows. Also, re-sticking of toner from cleaning brush 26 to press roller 22 never takes place and the calcium carbonate could be recovered and removed successfully.

On the other hand, when cleaning brush 26 is arranged in the upper stream of press roller 22 in the turning direction and cleaning roller 24 is arranged in the down stream of press roller 22 in the turning direction around press roller 22 (Comparison example 1), the volume of toner stuck to the surface of cleaning brush 26 reaches to 100 mg/cm$^2$ already when 60,000 sheets of paper were passed as the solid line β shows. Also, re-sticking of toner from cleaning brush 26 to press roller 22 take place. Thereafter the volume of stuck toner increases and as the result, recovery and removing of calcium carbonate became impossible.

Figure 5:
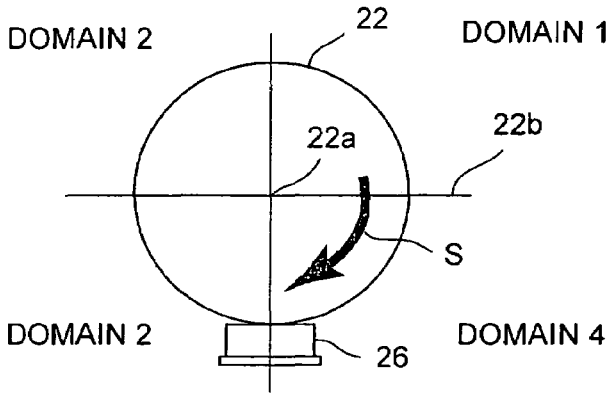
FIG. 5 is a sketch showing the location domain of the cleaning brush around the press roller at the experiment 2 according to the first embodiment of the present invention.
Figure 6:
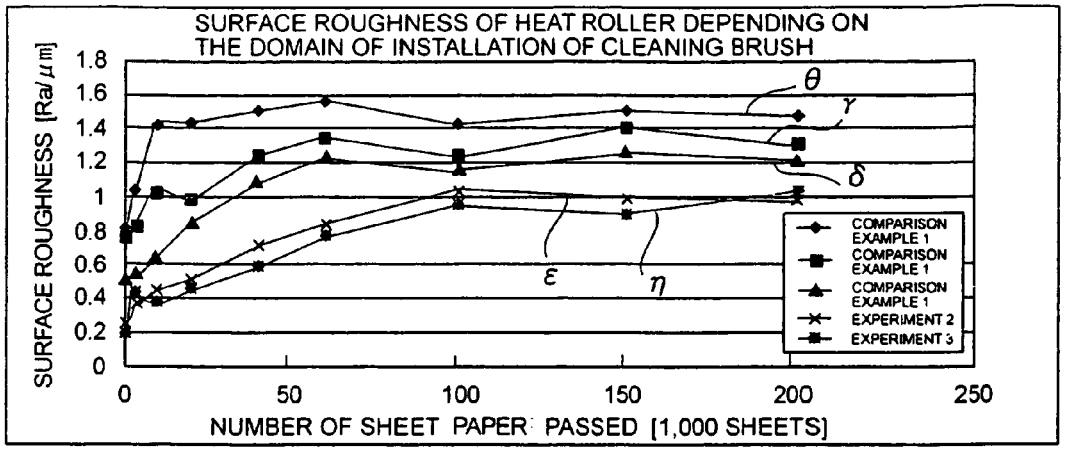
FIG. 6 is a graph showing the roughness of the surface of the heat roller of the comparison example 2 to comparison example 4 at the experiment 2 according to the first embodiment of the present invention.

(Experiment 2) Next, in the present embodiment, the domain of press roller 22 is divided into Domain 1 to Domain 4 as shown in FIG. 5, and the location of cleaning brush 26 is changed and the cleaning effect according to different location of cleaning roller 26 was measured. FIG. 6 is a graph showing the effect of cleaning brush 26, by converting the same to roughness of the surface of heat roller 21. The better the cleaning performance is, the less the increase of surface roughness Ra of heat roller 21 is.

The case when cleaning brush 26 is located in the Domain 1 (Comparison example 2) is indicated by the solid line y. The case when cleaning brush 26 is located in the Domain 2 (Comparison example 3) is indicated by the solid line 5. The case when cleaning brush 26 is located in the Domain 3 (Experiment 3) is indicated by the solid line ϵ. The case when cleaning brush 26 is located in the Domain 4 (Comparison example 4) is indicated by the solid line η. Also the surface roughness of heat roller 21, when cleaning brush 26 was not provided, is indicated by solid line θ. As the result, it was found that the increase of surface roughness Ra of heat roller 21 is small, when cleaning brush 26 is located in the Domain 3 or in the Domain 4 lower than the horizontal line 22*b* that passes through the center 22*a* of press roller 22, and the surface roughness stays at low value. When cleaning brush 26 is located in the Domain 1 or in the Domain 2 higher than the horizontal line 22*b*, particles of calcium carbonate recovered by cleaning roller 26 drops eventually onto press roller 22 that is located downward and re-sticks and thus the surface roughness Ra of heat roller 21 is supposed to increase.

Figure 7:
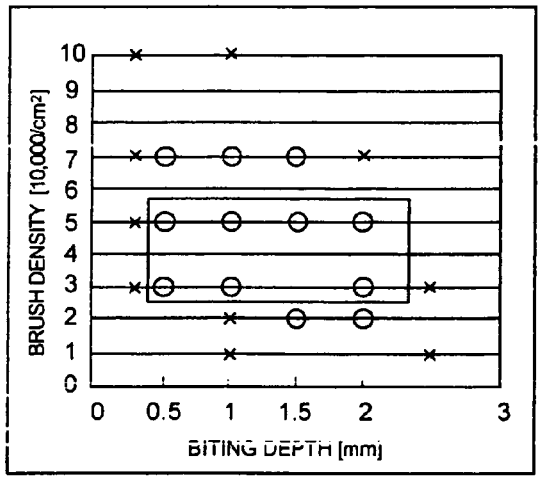
FIG. 7 is a graph showing the measuring result of the cleaning effect by changing the brush density of the cleaning brush and biting depth against the press roller, at the third experiment according to the first embodiment of the present invention.

(Experiment 3) Next, in the present embodiment cleaning effect according to biting depth of cleaning brush 26 against press roller 22 was measured by utilizing cleaning brushes 26 with a brush density of 10,000/cm$^2$, 20,000/cm$^2$, 30,000/cm$^2$, 50,000/cm$^2$, 70,000/cm$^2$ and 100,000/cm$^2$ respectively. As the result, as shown in FIG. 7, it was found that when the brush density is 30,000/cm$^2$ or 50,000/cm$^2$ and the biting depth of cleaning brush 26 is 0.5 to 2 mm, such a cleaning brush 26 has a good cleaning performance.

On the other hand, it was found that the surface of press roller 22 is damaged regardless the biting depth of cleaning brush 26 against press roller 22 when the brush density is 100,000/cm$^2$. It was also found that the surface of press roller 22 is damaged, when the biting depth of cleaning brush 26 against press roller 22 exceeds 1.5 mm, in case brush density of cleaning brush 26 is 70,000.cm$^2$.

Also, in case brush density is 10,000/cm$^2$, it was found that an inferior cleaning result takes place regardless the biting depth of cleaning brush 26 against press roller 22. Also it was found that an inferior cleaning result takes place, when the biting depth of cleaning brush 26 against press roller 22 is less 1.0 mm in case the brush density is 20,000/cm$^2$.

In the present embodiment composed as afore-mentioned, around press roller 22 cleaning brush 26 is provided in the down stream of press roller 22 in the turning direction of press roller 22 around press roller 22, and after toner stuck to press roller 22 is recovered by cleaning roller 24, calcium carbonate on press roller 22 is recovered by cleaning brush 26. By doing so, the volume of toner stuck to the surface of cleaning brush 26 is reduced and calcium carbonate recovery performance by means of cleaning brush 26 can be maintained. Accordingly, in spite of usage of paper P containing a large quantity of calcium carbonate as in the case of European paper or Chinese paper, corruption of press roller 22 by toner mixed with calcium carbonate can be prevented, and as the result the corruption of paper P is prevented.

As calcium carbonate does not remain on press roller 22, the surface of heat roller 21 is prevented from roughing by particles of calcium carbonate and the smoothness of the surface of heat roller 21 can be maintained. Therefore, the volume of toner sticking to heating roller 21 from paper P at the time of fixing can be reduced and the quality of fixed image can be improved in case that paper containing a large quantity of calcium carbonate is used.

Figure 8:
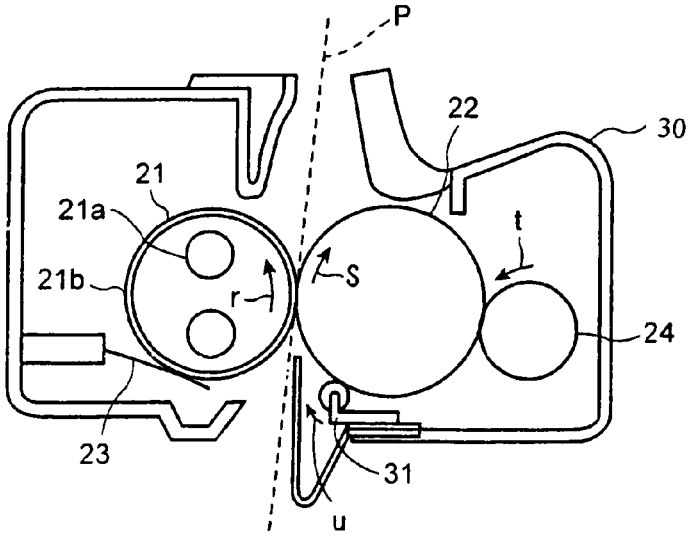
FIG. 8 is a sectional drawing showing the fixing device according to the second embodiment of the present invention.
Figure 9:
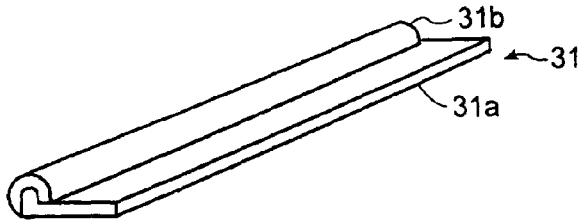
FIG. 9 is a perspective drawing showing the brush roller according to the second embodiment of the present invention.

Next, the second embodiment is described using FIG. 8 and FIG. 9. In this second embodiment, a brush roller is used instead of cleaning brush used in the first embodiment. As the others are same as in the first embodiment, the same symbols are allocated to the same members described in the first embodiment and the detailed description is eliminated. FIG. 8 indicates a fixing device 30. In the Domain 3 before reaching to the contact point with heat roller 21 in the down stream of cleaning roller 24 in the turning direction of press roller 22 around press roller 22, brush roller 31 contacts press roller 22. Brush roller 31 is a cleaning auxiliary member that recovers the adhesion on press roller 22. Brush roller 31 turns rayon brush 31*b* which is formed in a roller with a brush density of 50,000/cm$^2$ supported by a bracket plate 31*a* in the direction of arrow u against the turning direction of press roller 22. In other words, press roller 22 is turned by a driving unit which is not shown in the drawing.

By doing so, off set toner stuck to the surface of press roller 22 at the time of fixing is recovered by cleaning roller 24. Also in the case that paper P which containing a large quantity of calcium carbonate as European paper or Chinese paper, the particles of calcium carbonate remaining on press roller 22 after passing from cleaning roller 24 is removed at a high speed by rayon brush 31*b* that turns in the direction of arrow u, and press roller 22 becomes ready for next fixing process.

In the present embodiment as composed in such a way, after toner stuck to press roller 22 is recovered by cleaning roller 24, calcium carbonate on press roller 22 is recovered at a high speed by brush roller 31. By doing so, toner volume stuck to the surface of brush roller 31 is reduced same as in the case of the first embodiment, and the calcium carbonate recovery performance by means of brush roller 31 can be maintained. And then, in spite of usage of paper P containing a large quantity of calcium carbonate, the corruption of press roller 22 due to stuck toner can be prevented and as the result, the corruption of paper P is prevented.

Also, same as in the first embodiment, the surface of heat roller 21 is prevented from roughing by particles of calcium carbonate. Also, the toner volume stuck to heat roller 21 from paper P at the time of fixing can be reduced, and the quality of fixed image can be improved in case paper containing a large quantity of calcium carbonate is used. Furthermore, as brush roller 31 is driven against the turning direction of press roller 22, particles of calcium carbonate can be recovered quicker than the case of the first embodiment and thus its application to a high speed image forming device becomes possible.

Figure 10:
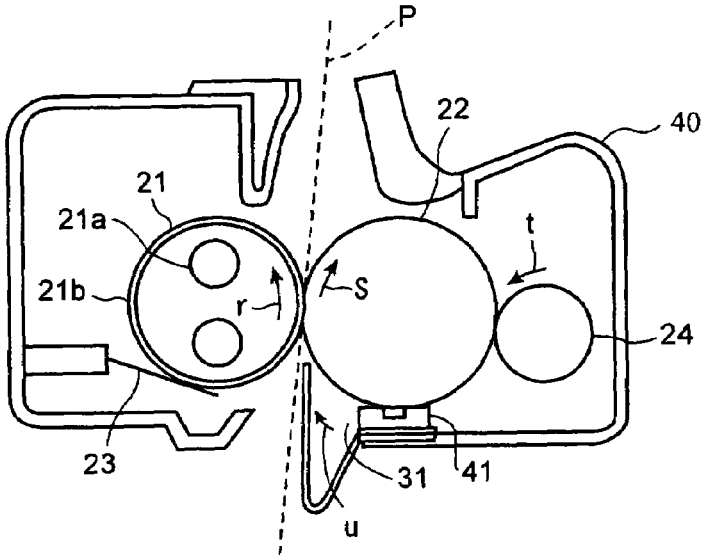
FIG. 10 is a sectional drawing showing the fixing device according to the third embodiment of the present invention.
Figure 11:
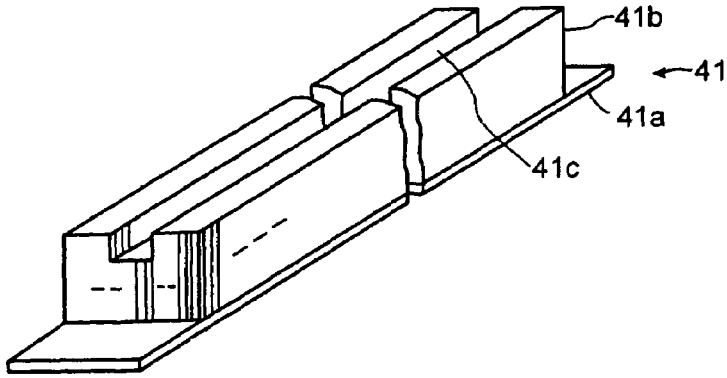
FIG. 11 is a perspective drawing showing the cleaning brush according to the third embodiment of the present invention.

Next, the third embodiment of the present invention is described using FIG. 10 and FIG. 11. In the third embodiment, cleaning brush and its shape differ from the ones of the first embodiment. As the others are same as in the case of the first embodiment, same symbols are allocated to the members same as in the first embodiment and its detailed description is eliminated. FIG. 10 shows a fixing device 40. Cleaning brush 41 contacts press roller 22 at the lowest point of press roller 22 before reaching the contact point with heat roller 21 in the down stream of cleaning roller 24 around press roller 22. Cleaning brush 41 is a cleaning auxiliary member that recovers the adhesion on press roller 22. As shown in FIG. 11, cleaning brush 41 comprises a rayon brush with a brush density of 50,000/cm$^2$ which is fixed to bracket plate 41*a* by means of both side adhesive tape (not shown in the drawing). Rayon brush 41*b* is provided with a slit 41*c* of about 3 mm in width in the center of the section brush 10 mm in width of 10 mm parallel with the longitudinal direction and the section is concave.

By doing so, the toner stuck to press roller 22 at the time of fixing is recovered by cleaning roller 24 and particles of calcium carbonate remaining on press roller 22 after passing from cleaning roller 24 is recovered by cleaning brush 41 and press roller 22 becomes ready for next fixing process. Calcium carbonate recovered by cleaning brush 41 does not deposit in the contact nip with press roller 22 but is taken into rayon brush 41*b* through slit 41*c*.

In the present embodiment composing as described aforementioned, after toner stuck to press roller 22 is recovered by cleaning roller 24, calcium carbonate on press roller 22 is recovered by cleaning brush 41. In the same way as the case of the first embodiment, the toner volume stuck to the surface of cleaning brush 41 is reduced, and the recovery performance of calcium carbonate by means of cleaning brush is maintained. Therefore, in spite of usage of paper containing a large quantity of calcium carbonate, the corruption of press roller 22 due to stuck toner is prevented. As the result, corruption of paper P can be prevented.

Also, in the same way as the first embodiment, the surface of heat roller 21 is prevented from roughing by particles of calcium carbonate, the volume of toner stuck from paper P to heat roller 21 is reduced at the time of fixing and the quality of fixed image is improved when paper containing a large quantity of calcium carbonate is used. Furthermore, as a slit 41*c* is formed in the center of cleaning brush 41 for getting away calcium carbonate depositing around the center of the contact nip with press roller 22, press roller 22 can be prevented from damage such as scratches due to deposited calcium carbonate.

In the meantime, the present invention is not limited in the aforementioned embodiments and the modification is possible without departing from the spirit and scope thereof. For example, the position of cleaning auxiliary member is not limited, when the cleaning auxiliary member is positioned in the down stream. However, in order to prevent re-sticking from cleaning auxiliary member to press roller, the cleaning auxiliary member is preferably positioned downward from the horizontal line that passes through the center of press roller. Also, if the adhesion on the press roller can be recovered by contact with press roller the cleaning auxiliary member may be also felt and a like, and their quality is not limited. Also, the characteristics of member to be fixed is not limited. Also, a pressing belt in a form of belt can be used in place of the press roller as the pressing member or the pressing means.

Furthermore, when the cleaning auxiliary member is formed as a brush, any brush density is acceptable, if it is in the range that the adhesion can be recovered successfully and the press roller is not damaged. Meantime the fixing device is not limited to be installed in copiers, but also in various image forming devices such as printers, facsimiles etc. Also, the quality and construction of the fixing members of the fixing device or press roller are not limited and a heater may be provided also on the side of press roller.

According to the present invention, the adhesion such as calcium carbonate on the pressing member is recovered by the cleaning auxiliary member in the down stream, after the toner stuck to the pressing member is recovered by the cleaning roller provided in the upper stream in the turning direction of the press roller around the pressing. Therefore, the toner volume stuck to cleaning member is reduced and the recovery performance of adhesion such as calcium carbonate by the cleaning auxiliary member can be maintained. By doing so, the corruption of the pressing member can be prevented in spite of the usage of paper containing a large quantity of calcium carbonate. As the result, the prevention of corruption of paper can be attained. Furthermore, the surface of fixing member is prevented from roughing by preventing corruption of the pressing member. As the result, the surface of fixing member can be kept smooth, and thus the adhesion of toner to the pressing member can be reduced at the time of fixing, and the quality of fixed image can be improved in spite of usage of paper containing a large quantity of calcium carbonate.

What is claimed is:

1. A fixing device comprising:

a fixing member;

a pressing member to convey a medium with toner image to be fixed in a prescribed direction by pressing the fixing member;

a cleaning member to recover toner stuck to the surface of the pressing member by contacting the pressing member; and a cleaning auxiliary member to remove particles adhered on the surface of the pressing member in the down stream of the cleaning member in the turning direction of the pressing member, wherein the cleaning auxiliary member is a brush having a cross section which is rectangular and which is provided with a slit parallel with the longitudinal direction on the surface.

2. The device as claimed in claim 1, wherein the removal position of the particles adhered on the surface of the pressing member by the cleaning auxiliary member is located downward from the horizontal line passing through the center of the pressing member.

3. The device as claimed in claim 1, wherein the cleaning auxiliary member is a cleaning brush in which fibers are planted at a brush density of 30,000/cm2 to 50,000/cm2.

4. The device as claimed in claim 1, wherein the biting depth of the cleaning auxiliary member against the pressing member is 0.5 to 2.0 mm.

5. A fixing device comprising:

fixing means for fixing a toner image on a medium;

pressing means for conveying the medium with the toner image to be fixed in a prescribed direction by pressing the fixing means;

cleaning means for recovering the toner stuck to the surface of the pressing means by contacting the pressing means; and cleaning auxiliary means for removing particles adhered on the surface of the pressing means in the down stream of the cleaning means in the turning direction of the pressing means, wherein the cleaning auxiliary means is a brush having a cross section which is rectangular and which is provided with a slit parallel with the longitudinal direction on the surface.

6. The device as claimed in claim 5, wherein the removal position of the particles adhered on the surface of the pressing means by the cleaning auxiliary means is located downward from the horizontal line passing through the center of the pressing means.

7. The device as claimed in claim 5, wherein the cleaning auxiliary means is a cleaning brush in which fibers are planted at a brush density of 30,000/cm2 to 50,000/cm2.

8. The device as claimed in claim 5, wherein the biting depth of the cleaning auxiliary means against the pressing means is 0.5 to 2.0 mm.

9. A fixing method comprising:

conveying medium with toner image to be fixed in a prescribed direction by pressing a pressing roller to a fixing member;

recovering the toner stuck to the surface of the pressing roller by having a cleaning member contact the pressing roller; and removing particles adhered on the surface on the pressing roller by a cleaning auxiliary member arranged in the down stream of the cleaning member in the turning direction of the pressing roller, wherein the cleaning auxiliary member is a brush having a cross section which is rectangular and which is provided with a slit parallel with the longitudinal direction on the surface.

10. The method as claimed in claim 9, wherein the removal position of the particles adhered on the surface of the pressing member by the cleaning auxiliary member is located downward from the horizontal line passing through the center of the pressing member.

11. The method as claimed in claim 9 wherein the cleaning auxiliary member is a cleaning brush in which fibers are planted at a brush density of 30,000/cm2 to 50,000/cmL.

12. The method as claimed in claim 9, wherein the biting depth of the cleaning auxiliary member against the pressing member is 0.5 to 2.0 mm.

* * * * *